US011920421B2

(12) United States Patent
Arnø-Kristoffersen et al.

(10) Patent No.: US 11,920,421 B2
(45) Date of Patent: Mar. 5, 2024

(54) SUBSEA WELLHEAD SUPPORT SYSTEM AND ASSOCIATED METHOD OF INSTALLING A SUBSEA WELLHEAD SUPPORT SYSTEM

(71) Applicant: FMC Kongsberg Subsea AS, Kongsberg (NO)

(72) Inventors: Kristian Arnø-Kristoffersen, Drammen (NO); Gøran Olof Sundqvist, Sandefjord (NO)

( * ) Notice: Subject to any disclaimer, the term of this patent is extended or adjusted under 35 U.S.C. 154(b) by 0 days.

(21) Appl. No.: 17/636,338

(22) PCT Filed: Aug. 17, 2020

(86) PCT No.: PCT/EP2020/073010
§ 371 (c)(1),
(2) Date: Feb. 17, 2022

(87) PCT Pub. No.: WO2021/032686
PCT Pub. Date: Feb. 25, 2021

(65) Prior Publication Data

US 2022/0341274 A1 Oct. 27, 2022

(30) Foreign Application Priority Data

Aug. 22, 2019 (NO) ..... 20191016

(51) Int. Cl.
*E21B 33/035* (2006.01)
*E21B 41/08* (2006.01)

(52) U.S. Cl.
CPC ..... *E21B 33/035* (2013.01); *E21B 41/08* (2013.01)

(58) Field of Classification Search
CPC ..... E21B 33/035; E21B 41/08
See application file for complete search history.

(56) References Cited

U.S. PATENT DOCUMENTS 8,950,500 B2 * 2/2015 Lieske, II ..... E21B 43/0122 166/71
11,041,372 B2 * 6/2021 Ellingsen ..... F16L 1/26
2016/0333641 A1 11/2016 Ellison
(Continued)

FOREIGN PATENT DOCUMENTS

CN 110199085 A * 9/2019 ..... E21B 15/006
GB 2560931 A 10/2018
GB 2566288 A 3/2019
(Continued)

*Primary Examiner* — Aaron L Lembo

(57) ABSTRACT

The invention relates to a subsea wellhead support system (1) comprising: —a foundation assembly (2); —a conductor housing (31) for supporting a wellhead (4); —a connection arrangement (5) between the foundation assembly (2) and the conductor housing (3'); wherein the connection arrangement (5) is configured to releasably connect the conductor housing (3') to the foundation assembly (2), such that: —during installation of the subsea wellhead support system (1), the conductor housing (1) can be fixed relative the foundation assembly (2), and—after installation of the subsea wellhead support system (1), the connection arrangement (5) can be released from the foundation assembly (2) allowing the conductor housing (3') to move parallel along a longitudinal direction of a throughgoing opening of the conductor housing (31).

17 Claims, 9 Drawing Sheets

(56) References Cited

U.S. PATENT DOCUMENTS

2017/0130547 A1* 5/2017 Bhatnagar ..... E21B 17/02

FOREIGN PATENT DOCUMENTS

| | | | | | |
|---|---|---|---|---|---|
| GB | 2569969 | A | | 7/2019 | |
| NO | 301555 | B1 | * | 11/1997 | ..... E21B 33/037 |
| NO | 331978 | B1 | * | 5/2012 | ..... E21B 33/035 |
| WO | WO 2017/079627 | A1 | | 5/2017 | |
| WO | WO 2017/155415 | A1 | | 9/2017 | |
| WO | WO 2018/009077 | A1 | | 1/2018 | |
| WO | WO 2018/056834 | A1 | | 3/2018 | |

* cited by examiner

SUBSEA WELLHEAD SUPPORT SYSTEM AND ASSOCIATED METHOD OF INSTALLING A SUBSEA WELLHEAD SUPPORT SYSTEM

The invention relates to a subsea wellhead support system and associated method of installing a subsea wellhead support system.

BACKGROUND OF THE INVENTION

Foundation structures such as suction anchors are normally used to create a foundation for subsea wells and subsea structures. The foundation structure is used to support the subsea well which extends into the seabed, the wellhead and associated wellhead equipment, such as a blowout preventer, casings or Christmas tree (Xmas Tree, XT). A single foundation structure in the form of a suction anchor may be employed to support single wells, typically with the well extending through an inner volume of the suction anchor. The suction anchor normally comprises a skirt forming an outer periphery of the suction anchor in the radial direction skirt. The suction anchor may support a housing for supporting a conductor, wellhead etc. This housing is welded, bolted or otherwise fixedly connected to the suction anchor. During installation, the suction anchor is lowered onto the seabed and then sucked into the seabed, initially by its own weight, and then in the final phase by reducing the pressure inside the skirt relative the surrounding pressure (thereby creating an underpressure). After installation of the suction anchor into the seabed or soil, well or well equipment can be installed or connected to the suction anchor to form a well that extends through the suction anchor into the seabed. One example of a prior art foundation structure exemplified above is known from WO 2018/009077 A1.

In the known solutions, the foundation structure and the housing supporting a conductor, wellhead etc. is fixedly connected in all operational positions, both during installation and after installation subsea. Any vertical forces originating from well-growth is thus transferred to the foundation structure.

It is therefore a need to address at least one of the drawbacks related to the prior art solutions.

It is an objective to provide a solution which allows well-growth where none, or a minimum of, vertical forces are transferred to the foundation assembly.

Furthermore, it is an objective of the invention to provide a solution which both may be operated using a Remotely Operated Vehicle (ROV) as well as without using ROV.

SUMMARY OF INVENTION

The invention is set forth in the independent claims, while the dependent claims describe other characteristics of the invention.

The invention provides a solution which saves time in the installation of subsea wellhead support systems. According to the invention, a subsea wellhead support system comprising a foundation assembly and a conductor assembly may be installed subsea in one run. The conductor assembly is fixedly mounted to the foundation assembly via a connection arrangement during installation.

Furthermore, a closed volume is defined by the internal walls (e.g. skirt) and top-cap of the foundation assembly and any seal(s) or intermediate elements between the foundation assembly and the conductor housing such that the foundation assembly may be installed into the soil as a result of its own weight and possibly assisted by underpressure.

A subsea wellhead support system is described which comprises:

- a foundation assembly;
- a conductor housing for supporting a wellhead;
- a connection arrangement between the foundation assembly and the conductor housing; wherein the connection arrangement is configured to releasably connect the conductor housing to the foundation assembly, such that:
- during installation of the subsea wellhead support system, the conductor housing can be fixed relative the foundation assembly, and
- after installation of the subsea wellhead support system, the connection arrangement can be released from the foundation assembly allowing the conductor housing to move parallel along a longitudinal direction of a through-going opening of the conductor housing.

Normally, after installation of the subsea wellhead support system, a center axis of the through-going opening of the conductor housing extends vertically. Therefore, the conductor housing moves up and down in a vertical direction.

The term conductor housing shall be understood as any housing with internal means/shoulders for hanging off something inside it—and allowed to move relative to the suction anchor due to well growth.

The foundation assembly normally comprises a skirt with a circular cross-section.

The suction anchor is preferably cylindrical to ease installation, i.e. it may have an open bottom end and a closed top end with a circular cross section. Alternative shapes of the suction anchor may include polygonal cylinders with triangular, rectangular, pentagonal etc. cross section.

A center axis of the through-going opening of the conductor housing is normally oriented in a vertical direction (i.e. directly downwards) during installation. The center axis is further preferably parallel with the part of the foundation structure (e.g. skirt of the foundation structure) penetrating the soil/seabed.

The foundation assembly can be a suction anchor.

The foundation assembly can be a well template structure with at least one well slot and a number of suction anchors.

The system may further comprise a conductor extension, wherein the conductor extension can be fixedly connected to the conductor housing. In this setup, the conductor housing and conductor extension are connected to each other and can be seen as one common element. They may be connected using standard connection means known to the skilled person, including, but not limited to welding, bolts, screws, glue, threads etc. A length of the conductor extension can be shorter, longer or identical to a length of the skirt of the foundation structure, such that the conductor extension may penetrate shallower, deeper or the same length as the skirt of the foundation structure, respectively.

The connection arrangement can be configured to either releasably connect the conductor housing directly to the foundation assembly or, to releasably connect the conductor housing to the foundation assembly indirectly via the conductor extension during the installation. After installation, the connection assembly is released such that the conductor housing is allowed to move parallel along a longitudinal direction of a through-going opening of the conductor housing.

The system may further comprise a fluid-tight cap covering a cross section of the conductor housing. The conductor housing can be arranged inside a periphery of a suction anchor. The fluid-tight cap is in this embodiment necessary in order to create a closed volume as, in this particular embodiment, there is no conductor extension or guide pipe extending into the seabed/soil.

The conductor housing (without conductor extension) is connected to the foundation structure utilizing the connection arrangement and may have one or more seals seal between the subsea foundation and the conductor housing during installation. In addition, the fluid-tight cap covers the cross section of a through-going opening of the conductor housing during installation. Thus, the foundation structure, seal(s), conductor housing and cap form a closed volume inside the foundation structure. After installation, the fluid-tight cap is removed, and the connection arrangement is released or releases upon forces from well-growth. The seal(s) stays in place and are not removed.

The system may further comprise a guide pipe fixedly connected to the foundation assembly, and the conductor housing may be arranged radially inside the guide pipe.

The guide pipe can be a so-called tailpipe. The guide pipe forms an integral part of the foundation assembly in all operational positions, i.e. both during installation and after installation, and follows any movement of the foundation assembly. The conductor housing is in this embodiment fixedly connected inside the guide pipe via the connection arrangement during installation, but is disconnected from the guide pipe after installation.

The guide pipe is normally cemented to the soil or seabed. In order to achieve this without cementing the conductor housing (and possible conductor extension connected to the conductor housing) to the guide pipe, a cementing operation may be followed by a wash-out of the annulus between the guide pipe and the conductor housing (and possible conductor extension). Then it is achieved that the conductor housing is allowed to move parallel along a longitudinal direction of a through-going opening of the conductor housing.

A length of the guide pipe can be shorter, longer or identical to a length of the skirt of the foundation structure, such that the guide pipe may penetrate shallower, deeper or the same length as the skirt of the foundation structure, respectively.

The system may further comprise a conductor housing with extension, and the conductor extension can be fixedly connected to the conductor housing.

Alternatively, the conductor housing may be provided without conductor extension. However, in both alternatives, the conductor housing is fixedly connected inside the guide pipe via the connection arrangement during installation, but is disconnected from the guide pipe after installation.

In an aspect, when the foundation structure is a suction anchor, the conductor housing can be arranged inside a periphery of the of the suction anchor.

In other words, the conductor housing is arranged inside an inner volume of the suction anchor.

This provides a closed volume inside the suction anchor.

The connection arrangement may comprise a safety device configured to fail when subjected to a force above a predetermined force thereby releasing the conductor housing from the fixed connection relative the foundation assembly.

The safety device may comprise shear pin, shear bolt, rupture disc, etc.

The safety device may be such that it provides a force sufficient to fixate the conductor housing preventing relative movement relative the foundation assembly when subjected to the relatively low forces experienced during installation. Furthermore, once the subsea system has been installed subsea, the safety device is configured to fail when subjected to forces above the predetermined force. Such predetermined forces may include, but are not limited to, well growth. Thereby the conductor housing is released or disconnected from the fixation relative the foundation assembly allowing parallel movement between the conductor housing and the foundation assembly.

The connection arrangement may comprise a lock operable by an ROV after installation of the subsea system.

The lock may e.g. be a mechanical lock such as a clamp or similar configuration configured to clamp the conductor housing relative the foundation assembly, which lock comprises a ROV friendly or ROV manipulatable interface rendering it possible to release or disconnect the lock using a ROV.

In an aspect, when the foundation structure is a suction anchor, the system may further comprise a pump arrangement comprising at least one pump configured to create an underpressure in an inner volume formed by a surface of a seabed, a side portion of the suction anchor and a top portion of the suction anchor relative the surrounding pressure during installation.

The pump arrangement assists in forcing the suction anchor downwards in the soil during installation. The term underpressure is to be understood as a reduced pressure relative the pressure when not using the at least one pump, and may also be denoted depression or negative pressure.

More than one pump may be provided. It is possible to provide dedicated pumps on each suction anchor or, in case of more than one suction anchor, a common pump for all suction anchors.

The pump may be arranged on a skid or form part of a Remotely Operated Vehicle (ROV).

In an aspect, when the foundation structure is a suction anchor, the conductor housing can be arranged radially outside a periphery of the suction anchor.

The conductor housing(s) can be arranged adjacent the outer periphery of the suction anchor or alternatively at a radial distance from the suction anchor.

In one aspect one foundation assembly may be connected to a number of conductor housings via a plurality of connection arrangements or one common connection arrangement.

All conductor housings can be arranged inside an outer periphery of a single suction anchor. Alternatively, all conductor housings can be arranged outside an outer periphery of a single suction anchor. Alternatively, at least one of the conductor housings can be arranged inside an outer periphery of a single suction anchor and the remaining conductor housings can be arranged outside the outer periphery of a single suction anchor.

Alternatively, at least one of the conductor housings can be arranged outside an outer periphery of a single suction anchor and the remaining conductor housings can be arranged inside the outer periphery of a single suction anchor.

A method of installing a subsea support system is further described, wherein the subsea support system comprises:

a foundation assembly;

a conductor housing for supporting a wellhead;

a connection arrangement between the foundation assembly and the conductor housing; wherein the method comprises the steps of:

prior to installing the subsea support system subsea, releasably connecting the conductor housing to the foundation assembly thereby fixing the conductor housing relative the foundation assembly;

installing the subsea support system subsea in one run;

after installation of the subsea wellhead support system, releasing the connection arrangement such as to release the conductor housing from the foundation assembly thereby allowing parallel movement of the conductor housing along a longitudinal direction of a through-going opening of the conductor housing.

Normally, after installation of the subsea wellhead support system, a center axis of the through-going opening of the conductor housing extends vertically. Therefore, the conductor housing moves up and down in a vertical direction.

The step of releasing the connection arrangement may comprise operating a Remotely Operated Vehicle to release the conductor housing from the foundation assembly.

The step of releasably connecting the conductor housing to the foundation assembly may comprise selecting a connection force of the connection arrangement which is above a maximum expected force occurring during the installation and below a median of expected force of a well-growth during production of a well extending through the conductor housing.

The conductor housing is itself supported, at least sideways (e.g. horizontally), by the foundation structure.

The connection arrangement may comprise shear element (s) which break at predetermined shear forces, and the method may comprise selecting type and/or number of shear element(s) based on said maximum expected installation forces and median expected well-growth forces.

For well abandonment, it will be possible after removing the locking ring, to remove the suction anchor or foundation structure from the rest of the well, thereby removing that part of the foundation structure positioned on the seabed, as the conductor housing and the well is not fixedly attached to the suction anchor or the foundation as such.

These and other characteristics of the invention will be apparent from the enclosed drawings, wherein;

BRIEF DESCRIPTION OF THE DRAWINGS

FIG. 4A shows a cylindrical foundation with a rectangular/quadratic cross section, FIG. 4B shows a cylindrical foundation with a triangular cross section, and FIG. 4C shows a cylindrical foundation with a pentagonal cross section;

DETAILED DESCRIPTION OF THE INVENTION

Figure 1A:
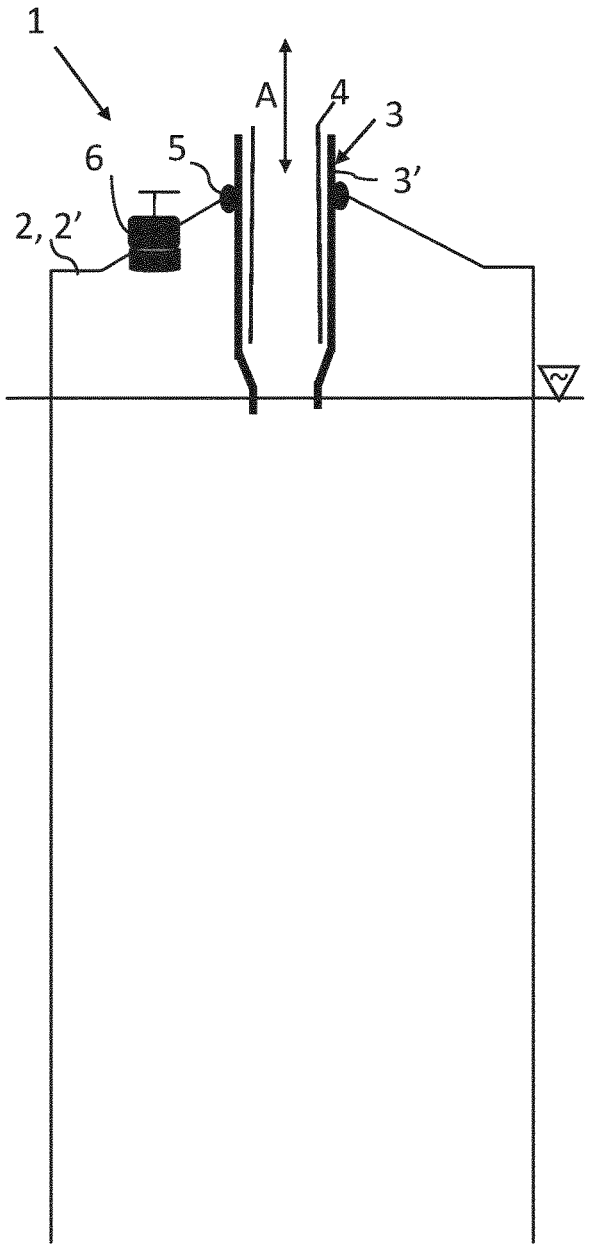
FIG. 1A shows a foundation structure in the form of a suction anchor, with a conductor housing inside the suction anchor.

In the following, embodiments of the invention will be discussed in more detail with reference to the appended drawings. It should be understood, however, that the drawings are not intended to limit the invention to the subject-matter depicted in the drawings. Furthermore, even if some of the features are described in relation to the subsea wellhead support system only, it is apparent that they are valid for the related method as well, and vice versa. Hence, any features described in relation to the method only are also valid for the subsea wellhead support system.

It is clear that the subsea wellhead support system may comprise additional elements not mentioned specifically or disclosed in the figures.

FIG. 1A shows a foundation structure in the form of a suction anchor, with a conductor housing inside the suction anchor 2'. A Subsea wellhead support system 1 comprises a foundation assembly 2 in the form of a suction anchor 2'. A conductor housing 3' is further disclosed. The conductor housing 3' supports a wellhead 4. The wellhead 4 is arranged radially inside the conductor housing 3'. A connection arrangement 5 is arranged between the suction anchor 2' and the conductor housing 3'. The connection arrangement 5 is configured to releasably connect the conductor housing 3' to the suction anchor 2' such that during installation of the subsea wellhead support system 1, the conductor housing (3') can be fixed relative the foundation assembly, and after installation of the subsea wellhead support system 1, the connection arrangement 5 can be released from the suction anchor 2 allowing the conductor housing 3' to move parallel along a longitudinal direction of a through-going opening of the conductor housing 3' as indicated by two-way arrow A. In other words, after installation and disconnection of the connection arrangement 5 locking the conductor housing to the suction anchor 2', the conductor housing 3' is allowed to move relative the suction anchor 2' in the vertical, or mainly vertical, direction indicated by the two-way arrow A.

The suction anchors would be equipped with standard equipment for setting suction anchor, for example suction pumps, installation hatch for water displacement. These features will be known to the skilled person and will not be further described herein.

A pump arrangement 6 comprising one or more pumps may be arranged in an upper part of the suction anchor 2' in order to provide for the possibility of sucking fluids from an inside of the suction anchor 2' to an outside of the suction anchor 2' thereby creating negative pressure inside the suction anchor 2' relative to the outside of the suction anchor thus assisting in penetration of the suction anchor 2' into the soil. The suction anchor 2' comprises sidewalls (i.e. "skirt) and top cover with an opening fit for receiving conductor housing 3' etc.

During installation of the system of FIG. 1A, i.e. a system without a conductor extension, it is required to seal the cross section of the conductor housing 3' in order to be able to create the required underpressure or negative pressure for suction of the suction anchor 2' into the seabed or soil. This cross section seal may be a fluid-tight cap covering a cross section of the conductor housing 3'.

Figure 1B:
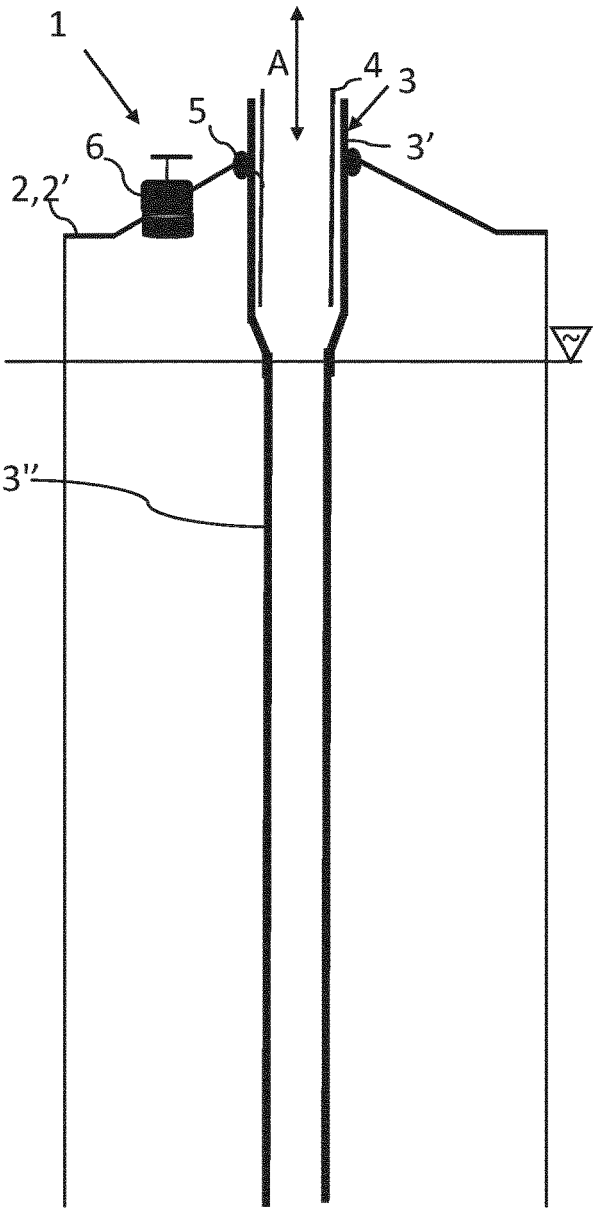
FIG. 1B is a similar view as FIG. 1A, but with the addition of a conductor extension connected to the conductor housing.

FIG. 1B is a similar view as FIG. 1A, but with the addition of a conductor extension connected to the conductor housing. In FIG. 1B, the conductor extension 3" has the same length as the skirt (i.e. the part of the suction anchor penetrating the soil) of the suction anchor 2'. Although it is shown that the length of the conductor extension 3" is equal to the length of the skirt, the skilled person will understand that the conductor extension 3" can also be shorter or longer than the length of the skirt of the suction anchor 2', such that the conductor extension 3" may penetrate the soil shallower, deeper or the same length as the skirt of the suction anchor 2'.

Contrary to the system of FIG. 1A, the presence of the conductor extension 3" in FIG. 1B renders the fluid-tight cap covering the cross section of the conductor housing 3' superfluous. This is because the conductor housing 3' and the conductor extension extend a sufficient length relative the skirt of the suction anchor 2' thereby creating a closed volume between an outside of the conductor assembly (i.e. the combination of conductor housing 3' and conductor extension 3") and the inner surface of the suction anchor (i.e. top cover of suction anchor 2' and sidewall/skirt of suction anchor 2').

Figure 1C:
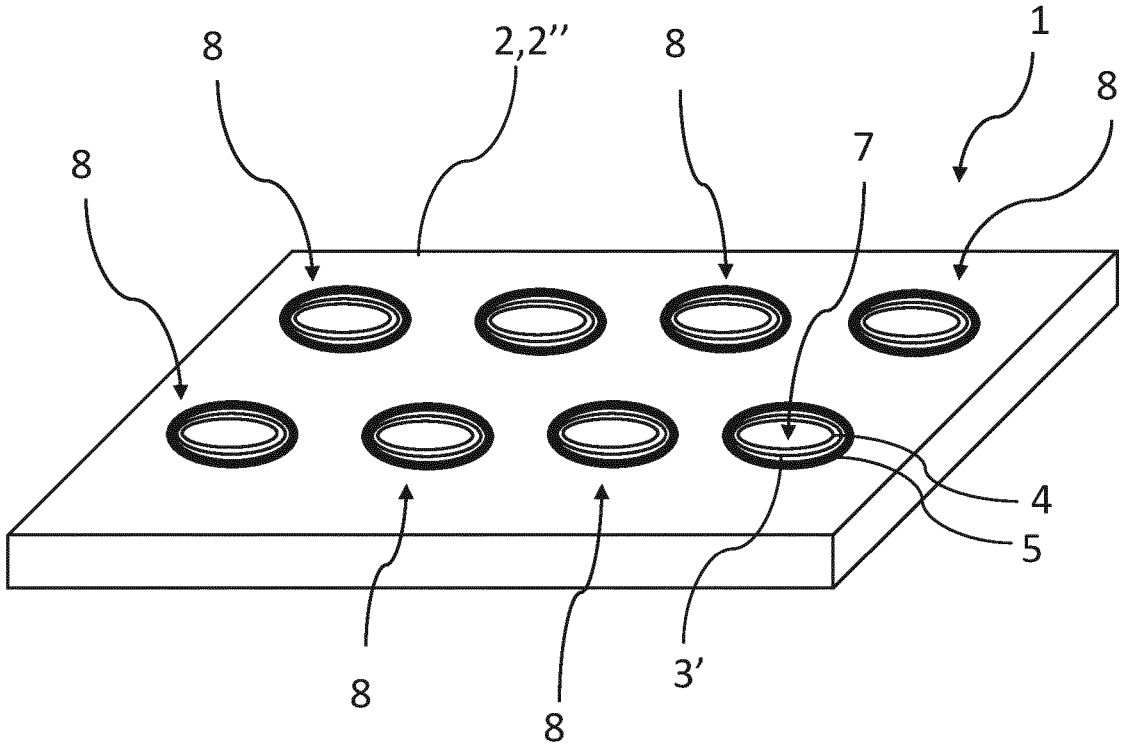
FIG. 1C is a simplified sketch of a foundation assembly in the form of a well template.

FIG. 1C is a simplified sketch of a foundation assembly 2 in the form of a well template 2". The well template 2" is disclosed with a total of eight well slots 8 arranged in two parallel rows in the well template 2". Each well slot 8 leads to one individual well. Each of the well slots 8 is disclosed with a conductor housing 3' supporting a wellhead 4. A connection arrangement 5 is configured to releasably connect the conductor housing 3' (and possibly a conductor extension 3" (not shown inn FIG. 1C)) to the foundation assembly 2, such that during installation of the subsea wellhead support system 1, the conductor housing 1 can be fixed relative the foundation assembly 2, and after installation of the subsea wellhead support system 1, the connection arrangement 5 can be released from the foundation assembly 2 allowing the conductor housing 3' to move parallel along a longitudinal direction of a through-going opening of the conductor housing 3'.

Figure 1D:
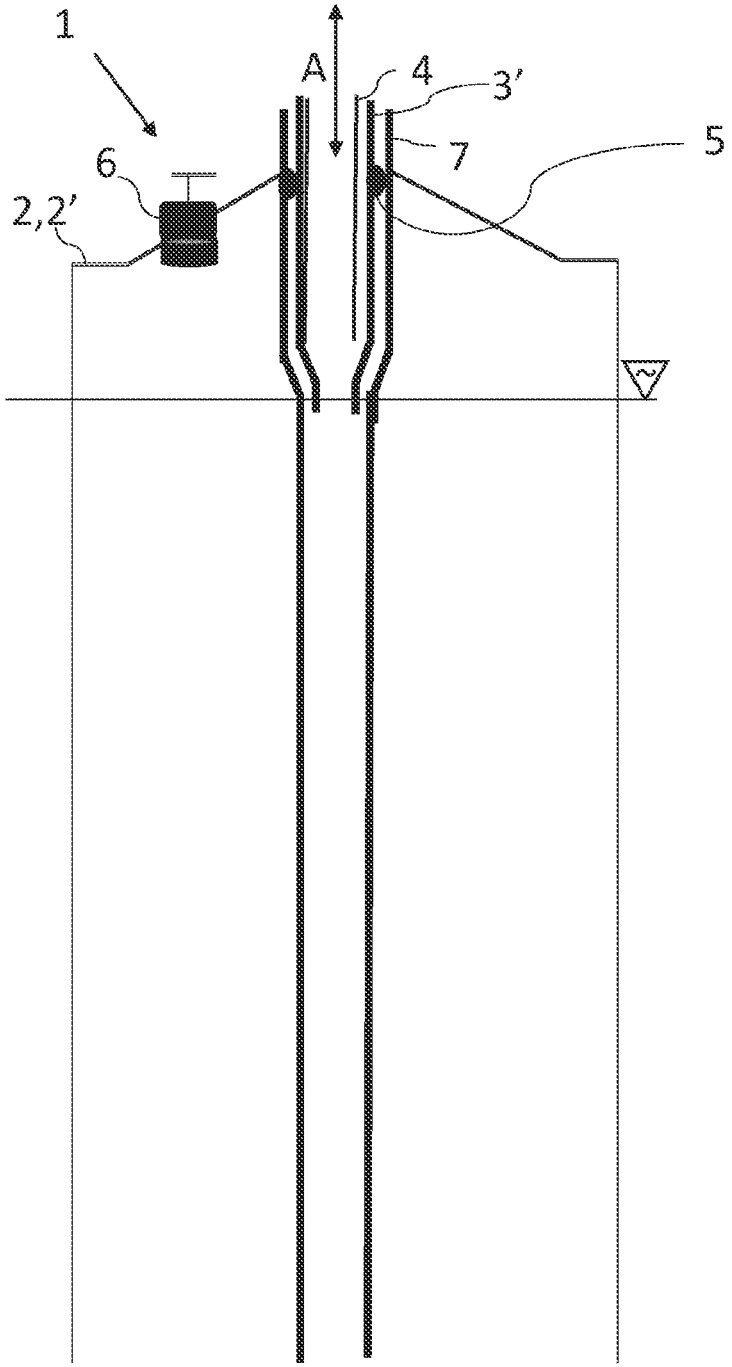
FIG. 1D shows a foundation structure in the form of a suction anchor with a guide pipe installed therein, where a conductor housing is arranged inside the guide pipe.

FIG. 1D shows a foundation structure in the form of a suction anchor 2' with a guide pipe 7 installed therein, where the conductor housing 3' is arranged inside the guide pipe 7. The guide pipe 7 is fixedly connected to the suction anchor 2'. The conductor housing 3' is arranged radially inside the guide pipe 7. The length of the guide pipe 7 is shown as being equal to the skirt of the suction anchor 2', but it can also be shorter or longer than the length of the skirt of the suction anchor 2'. As such, the guide pipe 7 may penetrate shallower, deeper or the same length as the skirt of the suction anchor 2'. In the embodiment of FIG. 1D, the connection arrangement 5 is arranged between the guide pipe 7 and the conductor housing 3'. The remaining features are similar as the embodiment in FIG. 1A.

Figure 1E:
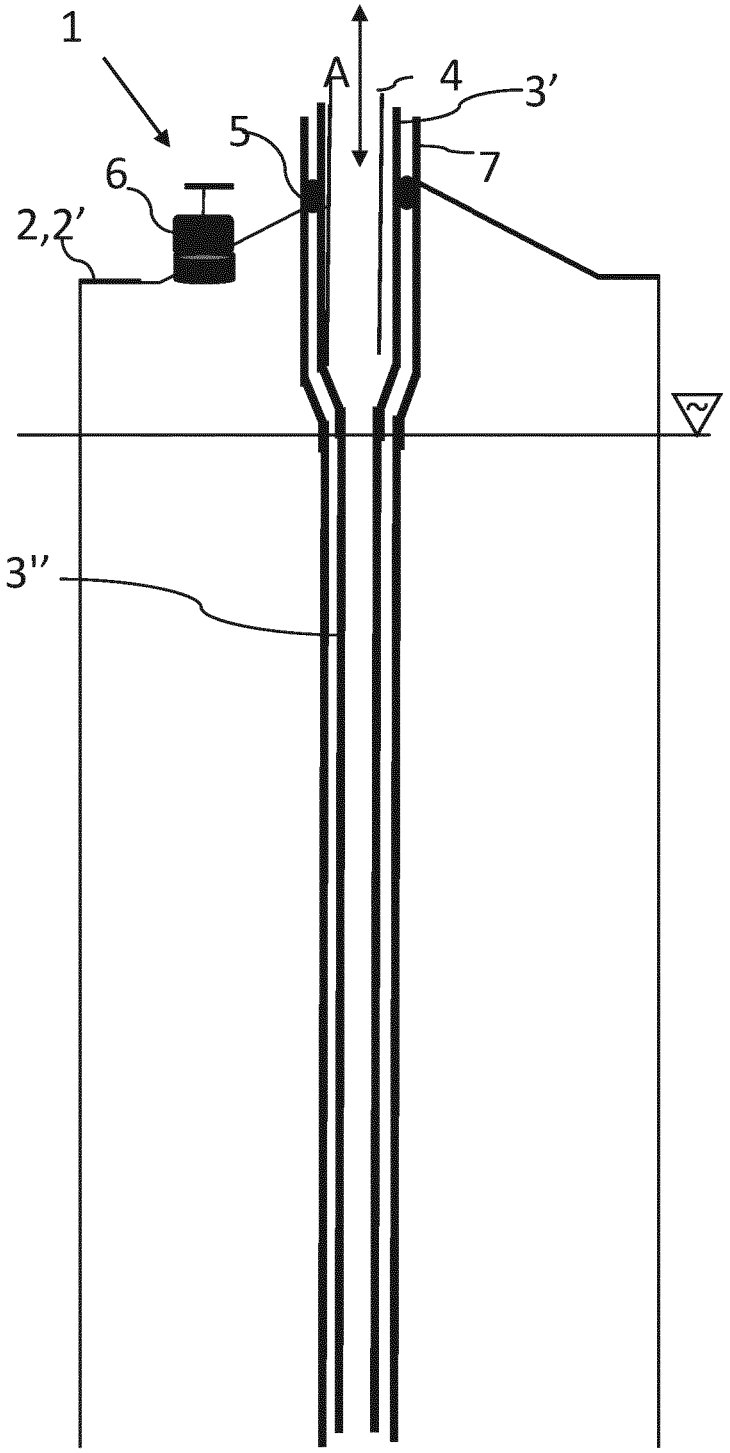
FIG. 1E shows a foundation structure in the form of a suction anchor with a guide pipe installed therein, where a conductor housing with a conductor extension is arranged inside the guide pipe.

FIG. 1E shows a foundation structure in the form of a suction anchor with a guide pipe installed therein, where a conductor housing with a conductor extension 3" is arranged inside the guide pipe 7. The remaining features are similar as in the embodiment of FIG. 1D and will not be repeated.

Figure 2A:
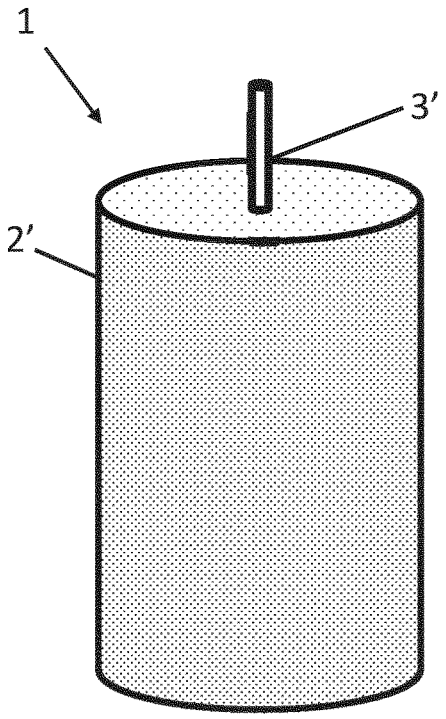
FIGS. 2A and 2B are perspective side view of cylindrical suction anchors with a circular cross section where the conductor housing is arranged inside the suction anchor.
Figure 2B:
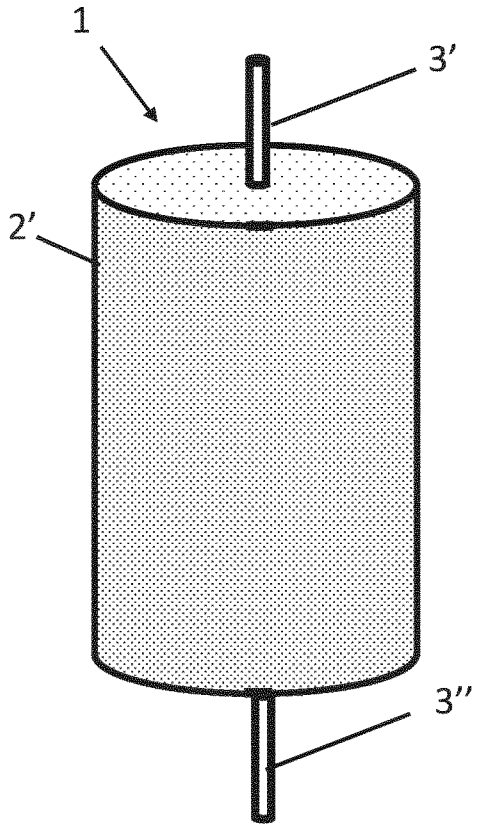

FIGS. 2A and 2B are perspective side views of cylindrical suction anchors 2' with a circular cross section where the conductor housing 3' is arranged inside (e.g. as disclosed in the center) the suction anchor 2'. The only difference between the figures being that in FIG. 2B the conductor housing 3' is connected to a conductor extension 3'. The other components which may form part of the system, such as the connection arrangement, guide pipe, pump arrangement, top cover etc. are omitted from FIGS. 2A and 2B to better illustrate the different possible positions of the conductor housing relative the suction anchor 2'.

Figure 3A:
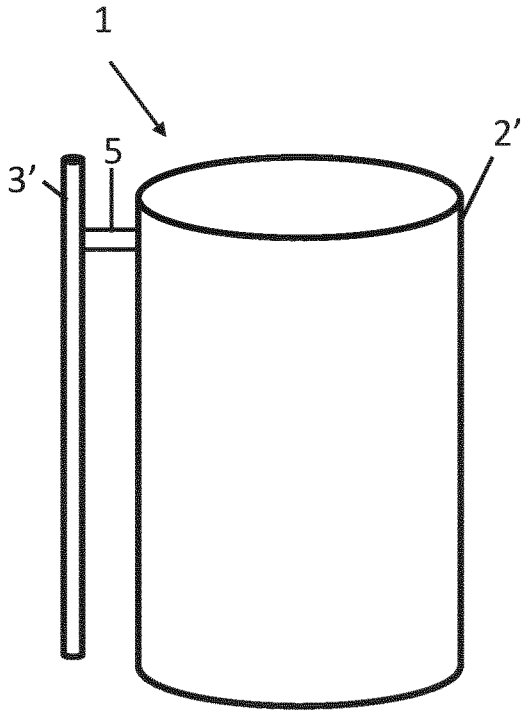
FIGS. 3A and 3B are perspective side view of cylindrical suction anchors with a circular cross section where the conductor housing(s) is arranged radially outside the periphery of the suction anchor.
Figure 3B:
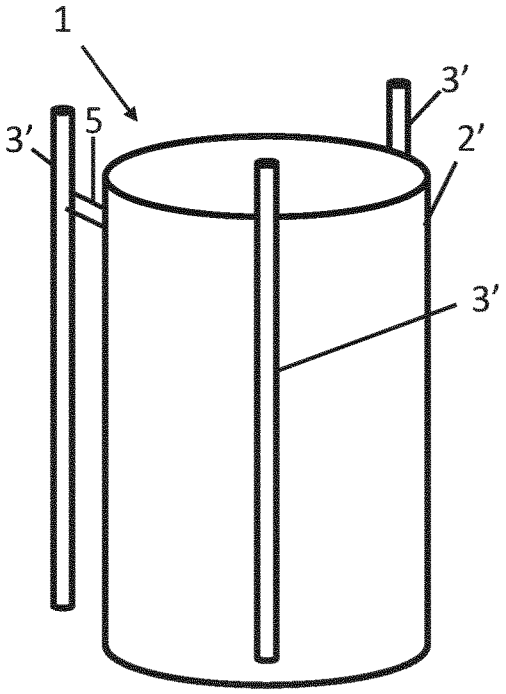

FIGS. 3A and 3B are perspective side views of cylindrical suction anchors 2' with a circular cross section where the conductor housing(s) 3' is arranged radially outside the horizontal extent of the suction anchor 2'. The other components which may form part of the system, such as the connection arrangement, guide pipe, pump arrangement, top cover etc. are omitted from FIGS. 2A and 3B to better illustrate the different possible positions of the conductor housing relative the suction anchor 2'. There may be one conductor housing (e.g. as shown in FIG. 3A) or two or more conductor housings 3' (e.g. for example three conductor housings as illustrated in FIG. 3B) radially outside the horizontal extent of the suction anchor 2'. Although not disclosed, in the figures, if there are more than one conductor housing 3' there may be at least one conductor housing inside the suction anchor 2' and at least one conductor housing 3' outside the horizontal extent of the suction anchor 2'.

Figure 4A:
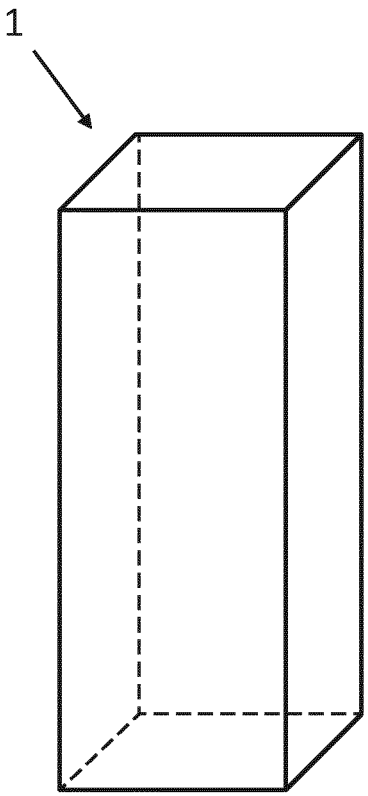
FIGS. 4A-4C show different examples of cylindrical foundation assemblies, where
Figure 4B:
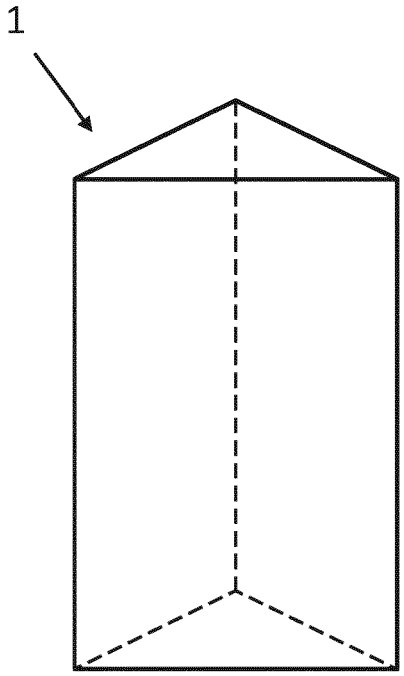
Figure 4C:
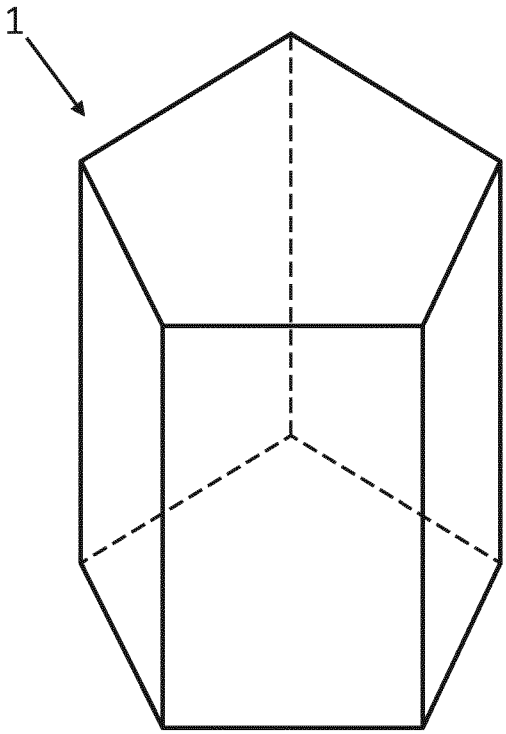

FIGS. 4A-4C show different examples of differently shaped cylindrical foundation assemblies, where FIG. 4A shows a cylindrical foundation with a rectangular/quadratic cross section, FIG. 4B shows a cylindrical foundation with a triangular cross section, and FIG. 4C shows a cylindrical foundation with a pentagonal cross section.

Figure 5A:
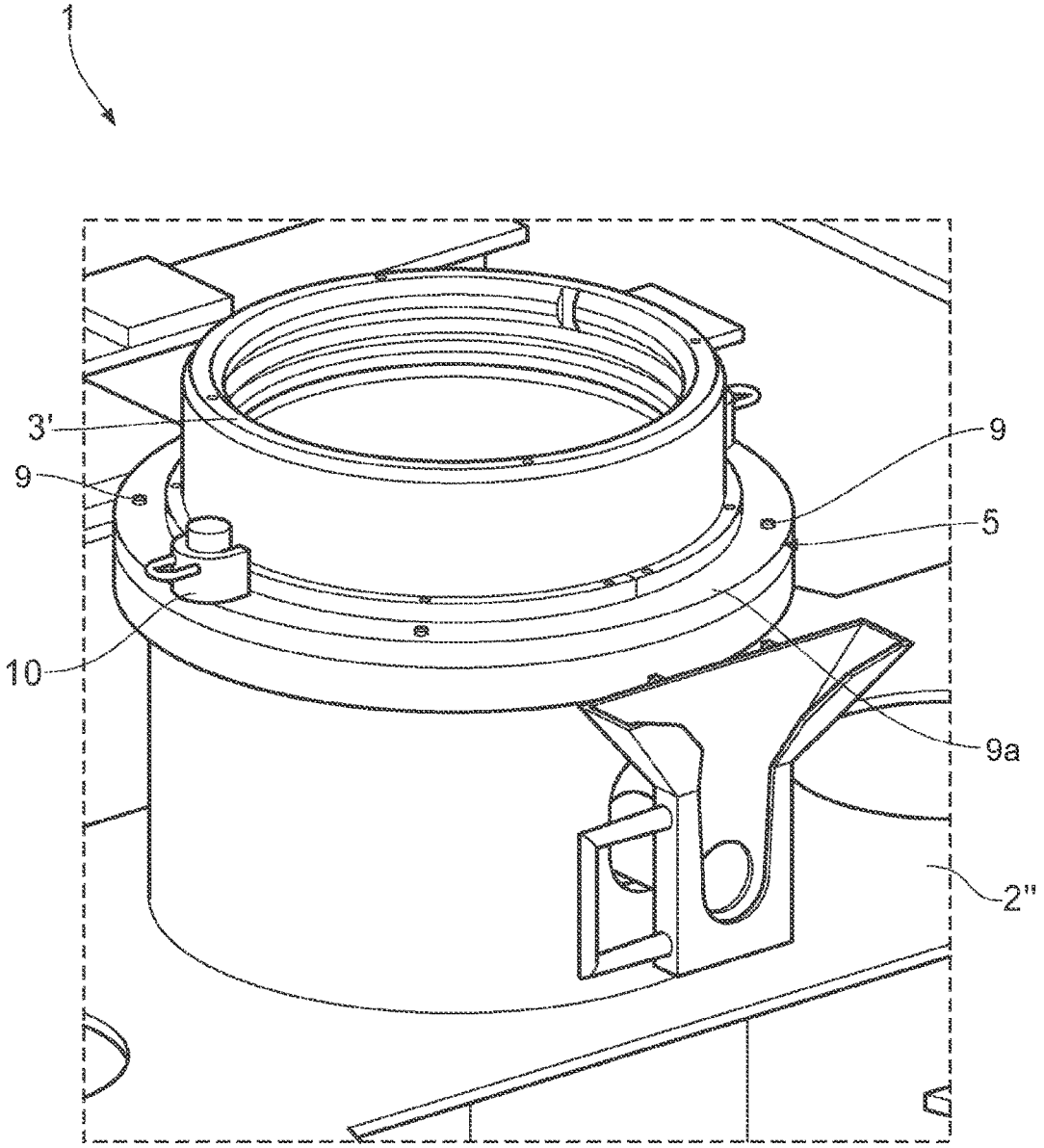
FIG. 5A shows a possible setup of a subsea wellhead support system when used in a foundation assembly in the form of a well template.

FIG. 5A shows a possible setup of a subsea wellhead support system 1 when used in a foundation assembly in the form of a well template 2". A connection arrangement 5 comprising one or more weak link bolt(s) 9 securing a locking ring 9*a* to the well template 2" is disclosed. The connection arrangement 5 may have two functions, including fixing the conductor housing 3' to the well template 2" during installation, as well as preventing uplift during cement operations (e.g. cementing of any guide pipe or other pipe to be cemented). The system may further comprise a contingency lock 10 to additionally secure the locking ring to the well template 2" during cementing operation(s).

After installation (and any cementing operation(s)), the contingency lock 10 is removed. This may be performed using ROV or other suitable means. The weak link(s) 9 are dimensioned such that they tear off when subject to forces created by well growth.

Figure 5B:
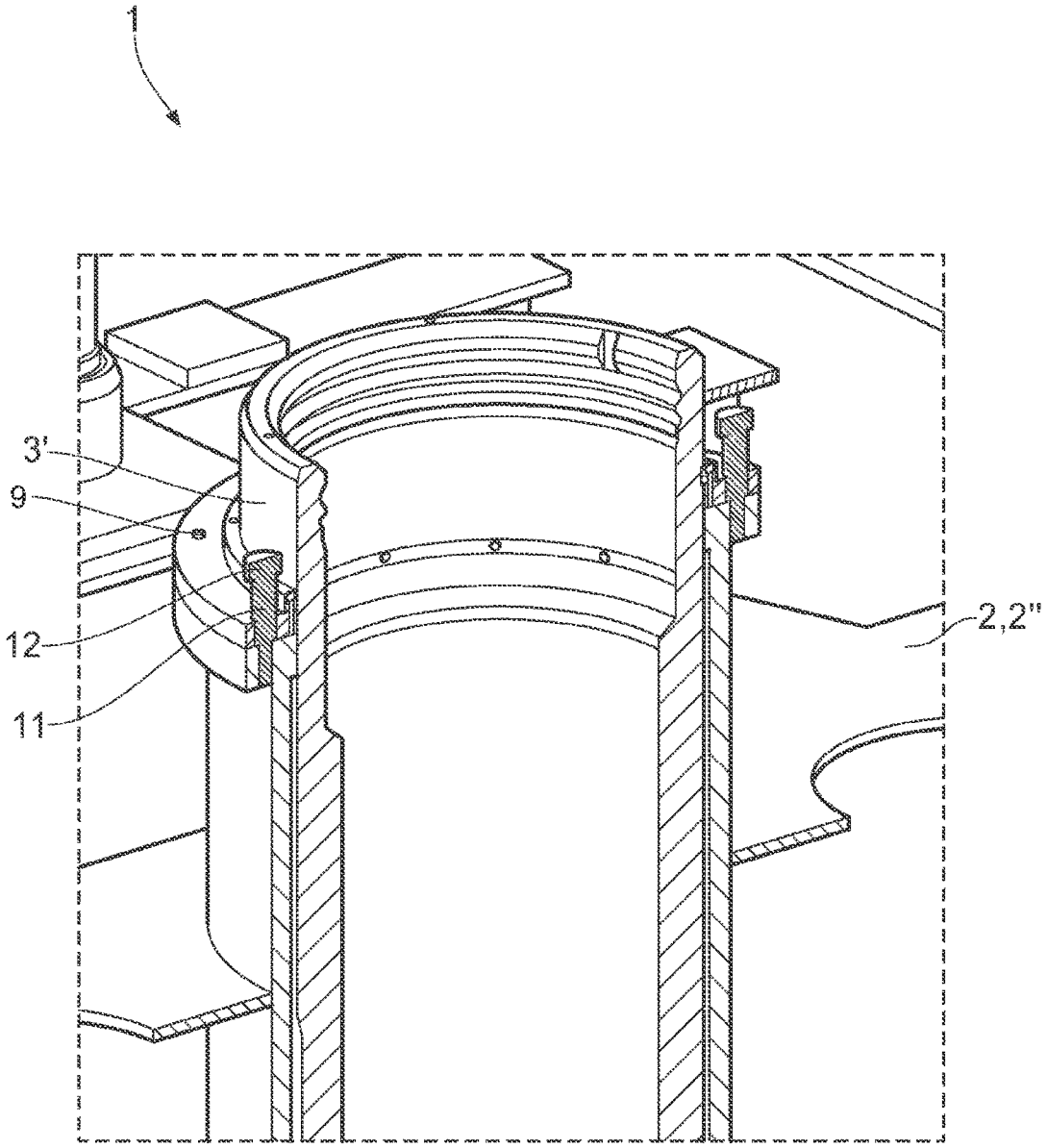
FIG. 5B shows a sectional view in a vertical plane of FIG. 5A after installation of the conductor housing and when the contingency lock(s) has been removed.

FIG. 5B shows a sectional view in a vertical plane of FIG. 5A after installation of the conductor housing 3' and when the contingency lock(s) 10 has been removed. As is seen from the FIG. 5B, vertical pins 11 fastened to the well template 2" may be provided with an end stop 12 that may allow for some well growth, for example in the magnitude of +−100 mm.

Figure 6A:
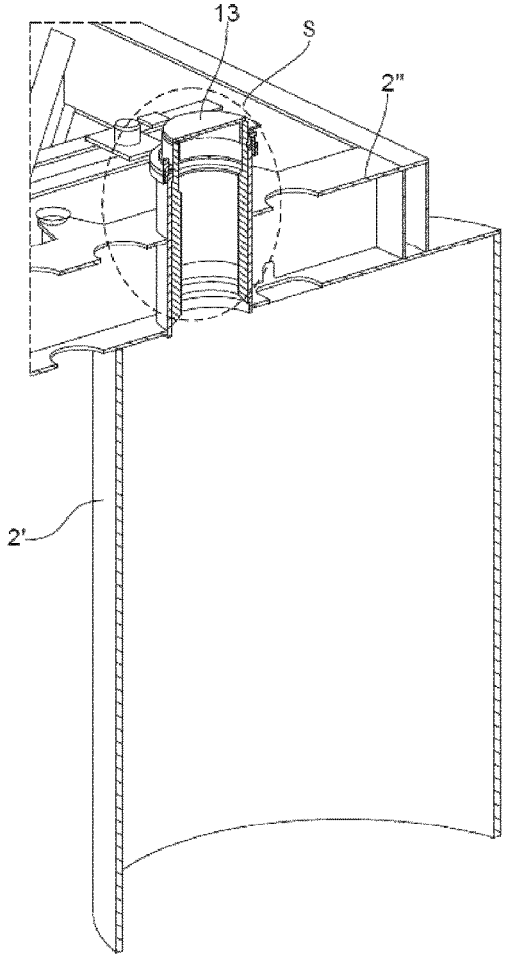
FIG. 6A shows a similar solution as in FIGS. 5A and 5B without a conductor extension.

FIG. 6A shows a similar solution as in FIGS. 5A and 5B without a conductor extension 3". In order to create a closed volume inside the suction anchor 2' during installation, a fluid tight end cap 13 covers the cross section of the conductor housing 3' during installation. After installation, the end cap 13 is removed.

Figure 6B:
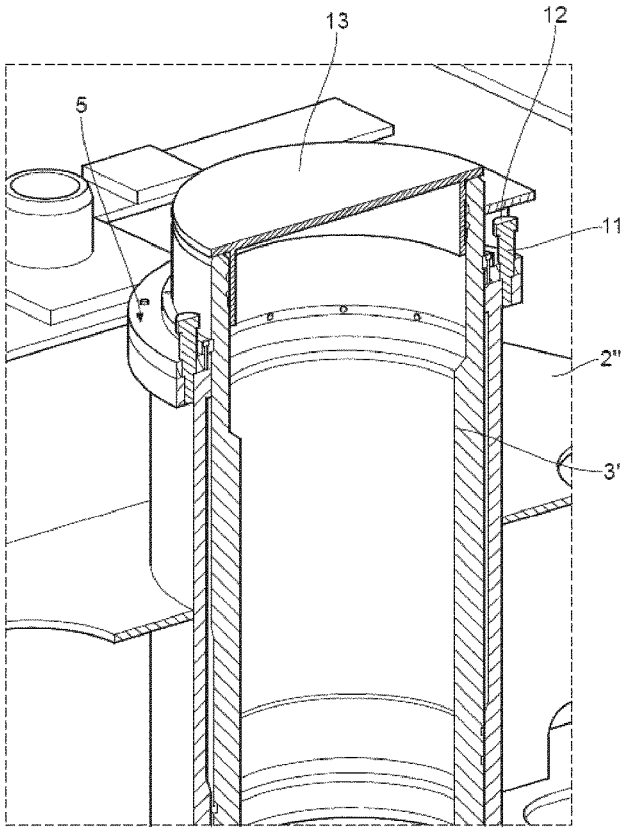
FIG. 6B is a detailed view of section S in FIG. 6A.

FIG. 6B is a detailed view of section S in FIG. 6A.

The invention is now explained with reference to non-limiting embodiments. However, a skilled person will understand that there may be made alternations and modifications to the embodiment that are within the scope of the invention as defined in the attached claims.

REFERENCE NUMERALS

| | |
|---|---|
| 1 | Subsea wellhead support system |
| 2 | Foundation assembly |
| 2' | Foundation assembly, suction anchor |
| 2" | Foundation assembly, well template |
| 3 | Conductor assembly |
| 3' | Conductor housing |
| 3" | Conductor extension |
| 4 | wellhead |
| 5 | Connection arrangement |
| 6 | Pump arrangement |
| 7 | Guide pipe |
| 8 | Well slot |
| 9 | Weak link bolt |
| 10 | Contingency lock |
| 11 | Vertical pin |
| 12 | End stop of vertical pin |
| 13 | Fluid tight cap |
| A | Arrow |
| S | Section |

The invention claimed is:

1. A subsea wellhead support system comprising:

a foundation assembly;

a conductor housing for supporting a wellhead; and a connection arrangement which is fixedly connected to the conductor housing;

wherein the connection arrangement is configured to releasably connect the conductor housing to the foundation assembly such that, during installation of the subsea wellhead support system, the conductor housing can be fixed relative the foundation assembly, and after installation of the subsea wellhead support system, the connection arrangement can be disconnected from the foundation assembly to allow the conductor housing to move parallel along a longitudinal direction of a through-going opening of the conductor housing.

2. The subsea system according to claim 1, wherein the foundation assembly comprises a suction anchor.

3. The subsea system according to claim 1, wherein the foundation assembly comprises a well template structure having at least one well slot and a number of suction anchors.

4. The subsea system according to claim 1, further comprising a conductor extension which is fixedly connected to the conductor housing.

5. The subsea system according to claim 1, further comprising a fluid-tight cap covering a cross section of the conductor housing.

6. The subsea system according to claim 1, further comprising a guide pipe fixedly connected to the foundation assembly, wherein the conductor housing is arranged radially inside the guide pipe.

7. The subsea system according to claim 6, further comprising a conductor extension which is fixedly connected to the conductor housing.

8. The subsea system according to claim 2, wherein the conductor housing is arranged inside a periphery of the of the suction anchor.

9. The subsea system according to claim 2, wherein the connection arrangement is configured to provide a fluid tight seal between the suction anchor and the conductor housing.

10. The subsea system according to claim 1, wherein the connection arrangement comprises a safety device configured to fail when subjected to a force above a predetermined force to thereby release the conductor housing from the foundation assembly.

11. The subsea system according to claim 1, wherein the connection arrangement comprises a lock operable by an ROV after installation of the subsea system.

12. The subsea system according to claim 2, further comprising a pump arrangement comprising at least one pump configured to create an underpressure in an inner volume formed by a surface of a seabed, a side portion of the suction anchor and a top portion of the suction anchor relative to a surrounding pressure.

13. The subsea system according to claim 2, wherein the conductor housing is arranged radially outside a periphery of the suction anchor.

14. A method of installing a subsea support system comprising:

a foundation assembly;

a conductor housing for supporting a wellhead; and a connection arrangement which is fixedly connected to the conductor housing;

wherein the method comprises the steps of:

prior to installing the subsea support system subsea, releasably connecting the conductor housing to the foundation assembly using the connection arrangement, thereby fixing the conductor housing relative the foundation assembly;

installing the subsea support system subsea in a single run;

after installation of the subsea wellhead support system, disconnecting the connection arrangement so as to release the conductor housing from the foundation assembly, thereby allowing parallel movement of the conductor housing along a longitudinal direction of a through-going opening of the conductor housing.

15. The method according to claim 14, wherein the step of disconnecting the connection arrangement comprises operating a Remotely Operated Vehicle to release the conductor housing from the foundation assembly.

16. The method according to claim 15, wherein the step of releasably connecting the conductor housing to the foundation assembly comprises selecting a connection force of the connection arrangement which is above a maximum expected force occurring during the installation and below a median of expected force of a well-growth during production of a well extending through the conductor housing.

17. The method according to claim 16, wherein the connection arrangement comprises shear element(s) which break at predetermined shear forces, and wherein the method comprises selecting a type and/or number of shear element (s) based on said maximum expected installation forces and the median expected well-growth forces.

* * * * *